US011519062B2

(12) United States Patent
Chen et al.

(10) Patent No.: US 11,519,062 B2
(45) Date of Patent: Dec. 6, 2022

(54) GRADIENT CONTROL METHOD FOR MICROSTRUCTURE ULTRAFINE CRYSTALLIZATION OF DEEP CONE COPPER SHAPED CHARGE LINER

(71) Applicant: No.59 Research Institute of China Ordnance Industry, Chongqing (CN)

(72) Inventors: Qiang Chen, Chongqing (CN); Dayu Shu, Chongqing (CN); Qiang Zhao, Chongqing (CN); Zude Zhao, Chongqing (CN); Luchang Che, Chongqing (CN); Yang Wu, Chongqing (CN); Chuankai Hu, Chongqing (CN); Hui Li, Chongqing (CN)

(73) Assignee: No.59 Research Institute of China Ordnance Industry, Chongqing (CN)

( * ) Notice: Subject to any disclaimer, the term of this patent is extended or adjusted under 35 U.S.C. 154(b) by 505 days.

(21) Appl. No.: 16/292,361

(22) Filed: Mar. 5, 2019

(65) Prior Publication Data

US 2019/0316242 A1 Oct. 17, 2019

(30) Foreign Application Priority Data

Apr. 16, 2018 (CN) ..... 201810341876.0

(51) Int. Cl.
*C22F 1/08* (2006.01)
*F42B 1/036* (2006.01)
*F42B 1/032* (2006.01)

(52) U.S. Cl.
CPC ..... *C22F 1/08* (2013.01); *F42B 1/036* (2013.01); *F42B 1/032* (2013.01)

(58) Field of Classification Search
CPC ..... C22F 1/08
(Continued)

(56) References Cited

U.S. PATENT DOCUMENTS 5,039,355 A * 8/1991 Daumas ..... F42B 1/032 148/554
2005/0092397 A1* 5/2005 Statnikov ..... B23K 13/00 148/400
2014/0026776 A1* 1/2014 Kecskes ..... C22C 45/001 102/305
(Continued)

FOREIGN PATENT DOCUMENTS

CN 101294238 A * 10/2008
CN 104388859 A * 3/2015
(Continued)

OTHER PUBLICATIONS

Bleicher F., et al.; "Mechanism of surface modification using machine hammer peening technology"; Manufacturing Technology; 61, 2012, p. 375-378 (Year: 2012).*
(Continued)

*Primary Examiner* — Alexandra M Moore
*Assistant Examiner* — Austin Pollock
(74) *Attorney, Agent, or Firm* — Bayramoglu Law Offices LLC

(57) ABSTRACT

A gradient control method for a microstructure ultrafine crystallization of a deep cone copper shaped charge liner includes the steps of an extrusion forming, a recrystallization heat treatment, and a high-frequency percussion. A multi-pass extrusion is used in the extrusion forming, and in the high-frequency percussion step, a percussion speed is 30,000 to 40,000 times/min, a percussion force is 1600 N to 2000 N, and a number of percussion times is 1 to 3. The forming and surface quality control of the deep cone shaped charge liner are realized by the control technology of the present invention; the plasticity of the material is improved, and fine crystal structures are obtained; and an ultrafine
(Continued)

grain gradient structure distributed along the thickness direction is formed in the inner surface of the shaped charge liner.

14 Claims, 2 Drawing Sheets
(2 of 2 Drawing Sheet(s) Filed in Color)

(58) Field of Classification Search
USPC ..... 148/679–687
See application file for complete search history.

(56) References Cited

U.S. PATENT DOCUMENTS

| | | | | |
|---|---|---|---|---|
| 2019/0299480 | A1* | 10/2019 | Shamoto | B26D 5/005 |
| 2020/0181722 | A1* | 6/2020 | Lu | C21D 1/09 |

FOREIGN PATENT DOCUMENTS

| | | | | |
|---|---|---|---|---|
| CN | 104630674 | A | * | 5/2015 |
| RU | 2231739 | C2 | * | 6/2004 |

OTHER PUBLICATIONS

Jones Metal Products, "Benefits of Vacuum Heat Treatment", retrieved May 4, 2021, date Jan. 31, 2012; https://www.jmpforming.com/blog/vacuum-heat-treating/benefits-of-vacuum-heat-treatment.htm (Year: 2012).*

* cited by examiner

GRADIENT CONTROL METHOD FOR MICROSTRUCTURE ULTRAFINE CRYSTALLIZATION OF DEEP CONE COPPER SHAPED CHARGE LINER

CROSS REFERENCE TO RELATED APPLICATIONS

This application is based upon and claims priority to Chinese Patent Application No. 201810341876.0, filed on Apr. 16, 2018, the entire contents of which are incorporated herein by reference.

TECHNICAL FIELD

The present invention relates to the technical field of metal plastic forming, particularly to a gradient control method for a microstructure ultrafine crystallization of a deep cone copper shaped charge liner.

BACKGROUND

The typical shaped charge jet has a relatively high head velocity (greater than or equal to 8500 m/s) and a low tail velocity (about 3000 m/s), so this kind of velocity gradient allows the jet to be pulled long (reaching 20 to 100 times apertures of the shaped charge liner) under the condition of a certain bursting height, having high penetration capability. The penetration capability of the jet is proportional to the length of the continuous jet. However, due to the internal defects of the metal and the expansion of the jet, the jet may eventually break into several segments of jujube pit like particles in the axial direction, thus limiting the length of the continuous jet and the transmission of the penetration capability. Moreover, the broken particles are disturbed by each other, causing the penetration capability thereof dropping sharply.

Domestic and foreign research institutions have done extensive and in-depth research on the relationship among the internal structure (grain size, morphology, grain boundary, etc.), manufacturing process and high-explosive anti-tank performance of shaped charge liners. Results show that grain size, grain orientation, and other intrinsic performance parameters of the shaped charge liner have significant effects on the penetration capability. Grain size and morphology are the first factors affecting the intrinsic quality of penetration performance, especially the size effect of nanocrystal has attracted high attention of scientists and technicians.

At present, the materials for manufacturing the shaped charge liner mainly include pure copper, pure iron, depleted uranium, copper alloy, etc., wherein the pure copper material has a high density (density of the copper is 8.93 g/cm$^3$), a good plasticity (elongation at room temperature is more than or equal to 45%), a high sound velocity (4.7 km/s), and a high melting point (1083° C.). Meanwhile, the material has excellent forming performance (plastic forming limit reaches 95%), an abundant storage, and a low price, which are capable of meeting the requirements of high performance and low cost of conventional weapons warheads. The development history of copper, used as shaped charge liners for shaped charge warheads, has been more than 50 years. Ninety-eight percent of the existing high-explosive anti-tank warheads use copper shaped charge liners. A large number of ballistic tests and research have shown that large-size shaped charge liners (aperture is greater than 150 mm) made of hot-rolled, extruded copper rods or sheet materials have an average grain size of 30-60 μm and a high-explosive anti-tank penetration capability of less than 8 times apertures of the shaped charge liner, which cannot effectively hit the new generation of reactive armor, ceramic armor, composite armor and other solid targets (protection capability is 11 to 13 times aperture of the shaped charge liner). The preparation of ultrafine grain shaped charge liner has become one of the key techniques to develop the powerful high-explosive anti-tank warheads.

From the relationship between the length of the continuous jet and the penetration capability, and the theory of grain boundary of metal materials, the grain structure of the shaped charge liner is changed from micrometer-scale to nanometer-scale, which may improve the isotropic, yield ratio and ductility of the shaped charge liner, and further enhance damage power of the warheads. The existing severe plastic deformation technology mainly includes conventional extrusion or forging, reversing rolling, and equal channel angular extrusion. The technology has the following disadvantages. First, the grain size is not uniform, and mischcrystal structures exist in weak deformation zone or severe deformation zone. Second, the anisotropy of rolled sheet material is large. Third, nanocrystal materials formed by the equal channel angular extrusion have low yield, and poor consistency in performance.

Fourth, the process of preparing nanocrystal by a single process is long and complicated. Fifth, the weight of effective jet body formed on the inner surface of the shaped charge liner accounts for 20% of the total weight, and the cost of preparing a shaped charge liner completely made of nanocrystal is high. According to the velocity gradient effect of the jet of the shaped charge liner, the present application provides a gradient control method for a microstructure ultrafine crystallization of a deep cone copper shaped charge liner.

SUMMARY

The technical problem to be solved by the present invention is to provide a gradient control method for a microstructure ultrafine crystallization of a deep cone copper shaped charge liner, which mainly includes the steps of multi-pass extrusion forming, recrystallization heat treatment, high-frequency percussion gradient, and fine shaping (FIG. 1). The prepared shaped charge liner forms a gradient distribution along the thickness direction, and the inner layer grain structure is ultrafine crystallized.

Moreover, the dimensional accuracy is high, the geometric symmetry is good, and the penetration capability and the stability of the high-explosive anti-tank warheads may be significantly improved.

The present invention is realized by the following technical solutions.

A gradient control method for a microstructure ultrafine crystallization of a deep cone copper shaped charge liner includes the steps of extrusion forming, recrystallization heat treatment, and high-frequency percussion. The multi-pass extrusion is used in the extrusion forming, and in the step of the high-frequency percussion, the percussion speed is 30,000 to 40,000 times/min, the percussion force is 1600 N to 2000 N, and the number of percussion times is 1 to 3.

In order to further reduce the difference of circumferential wall thickness, the multi-pass extrusion refers to 4 to 8 passes of extrusion deformation under the actions of a three-dimensional compressive stress and a deformation rate of 2 to 5 mm/s, having a deformation amount of 5 to 30% for each pass.

In order to eliminate the fibrous structure formed by extrusion deformation, the recrystallization heat treatment is carried out in a vacuum heat treatment furnace, the temperature is kept at 180 to 220° C., a holding time is 45 to 75 min, and a vacuum degree is more than or equal to $2\times10^{-3}$ Pa.

In order to improve the uniformity of the structure and the plastic forming performance of the material, the annealing treatment is performed before the extrusion forming, the annealing temperature is 400 to 450° C., the annealing time is 1.5 to 2 h, and then the material is cooled to below 100° C. with a furnace, the vacuum degree of the furnace is more than or equal to $2\times10^{-3}$ Pa.

A gradient control method for a microstructure ultrafine crystallization of a deep cone copper shaped charge liner is achieved by the following process steps:

(1) preparation of billet: according to the diagram of the formed piece of the deep cone copper shaped charge liner, calculating the volume of the material; according to plastic forming theory, and near-uniform plastic deformation principle, selecting the proper size of the billet; cutting the copper rod into a corresponding length according to constant-volume principle of plastic forming; the diameter of the copper rod is ϕ60 to 90 mm, and the material designation of the copper rod may be chosen from TU1, TU2, T2, T3, etc.; putting the billet into a vacuum heat treatment furnace to perform an annealing treatment, wherein the annealing temperature is 400 to 450° C., the annealing time is 1.5 to 2 h, and then the billet is cooled to below 100° C. with the furnace, the vacuum degree is more than or equal to $2\times10^{-3}$ Pa, to obtain a uniform structure, and improve the plastic forming performance of the material.

(2) multi-pass extrusion forming: placing the billet obtained in step (1) in the mould cavity of the extrusion die, under the actions of the three-dimensional compressive stress and the deformation rate of 2 mm/s to 5 mm/s, performing 4 to 8 passes of the extrusion deformation, and the deformation amount for each pass is between 5% and 30%;

during the forming process, the surface of the billet and the inner surface of the mould cavity are respectively coated with a lubricant, and the difference of circumferential wall thickness of the deep cone copper shaped charge liner formed by multi-pass extrusion forming is less than or equal to 0.1 mm.

(3) recrystallization heat treatment: placing the deep cone copper shaped charge liner obtained in step (2) in a vacuum heat treatment furnace, wherein the temperature is kept at 180° C. to 220° C. for 45 min to 75 min, and the vacuum degree is more than or equal to $2\times10^{-3}$ Pa;

the deep cone copper shaped charge liners have an average grain size of 2.8 to 10 μm.

(4) high-frequency percussion gradient: performing inner surface fine crystallization treatment on the cone shaped charge liner obtained in step (3) on a high-frequency vibration percussion device, wherein the percussion speed is 30,000 to 40,000 times/min, the percussion force is 1600 N to 2000 N, and the number of percussion times is 1 to 3.

(5) fine shaping: placing the cone shaped charge liner obtained in step (4) in the mould cavity of the extrusion die, under the actions of three-dimensional compressive stress and deformation rate of 1 mm/s to 3 mm/s, performing 1 to 4 passes of fine shaping, and the deformation amount for each pass is less than or equal to 2%.

The deviation value of the inner taper angle of the cone shaped charge liner is less than or equal to 2', the difference of circumferential wall thickness is less than or equal to 0.08 mm, and the surface roughness is Ra 0.1 μm.

In the 4 to 8 passes of the extrusion deformation in step (2), according to the aperture size of the deep cone shaped charge liner, the inner cone angle, the inner cone depth, the wall thickness and other shape and structure characteristics, the required deformation passes and other processes may be designed. The number of the extrusion deformation passes of the part with small size and simple shape is low. In the shaped charge liners having the same aperture size, the number of deformation passes of the shaped charge liner having a single taper angle are less than that of the deformation passes of the shaped charge liner having a double taper angle.

In step (2), the deformation amount is 5% to 30%; according to the deformation passes and the structure characteristics of the part, the deformation amount for each pass is reasonably distributed, the deformation amount decreases with the increase of the deformation passes, and the plastic forming of the shaped charge liner is controlled by the gradient deformation amount.

In step (2), the lubricant includes common lubricants such as tea oil, fine billeting oil, castor oil, rapeseed oil, etc., or a combination thereof. In each pass of forming process, the lubricant is coated on the surfaces of the billet and the mould cavity to reduce the friction between contact surfaces of the billet and the mould, enhance the fluidity of the metal during the forming process, and improve the surface quality of the formed component.

In the 1 to 3 times of high-frequency percussion in step (4), the times of high-frequency percussion treatment is determined according to parameters such as wall thickness and grain size of the shaped charge liner.

In the 1 to 4 passes of fine shaping in step (5), the times of fine shaping is determined according to parameters such as the shape and aperture of the shaped charge liner.

Beneficial Effects:

In the present invention, the forming and surface quality control of the deep cone shaped charge liner are realized by the control technology; the plasticity of the material is improved, and fine crystalline structures are obtained; and an ultrafine grained gradient structure distributed along the thickness direction is formed in the inner surface of the shaped charge liner. Through this method, the ultrafine grained gradient structure distributed along the thickness direction of the shaped charge liner is obtained, and the structure distribution thereof along the direction of generatrix is uniform, which provides a new preparation method for the development of the high-performance deep cone copper shaped charge liner.

The present invention overcomes the technical problems such as monotonic morphology of the inner structure, and uneven structure distribution existing in the components obtained by conventional preparation method. At the same time, the present invention has the advantages of high production efficiency, good process stability and easy realization of industrial production, etc.

(1) Product performance is good. High-frequency percussion is used for fine graining. The density of the structure on the inner layer of the shaped charge liner is increased, the grain structure is graded, and the stability and the ductility of the jet of the shaped charge liner are stronger under a high temperature and a high pressure.

(2) The consistency of the product size is good. A deviation value of the taper angle of the deep cone shaped charge liner is less than or equal to 2', a difference of circumferential wall thickness is less than or equal to 0.05 mm, and a surface roughness is Ra 0.1 μm.

(3) The material utilization of products is high. A mechanical machining allowance of 0.2 mm to 0.4 mm is left on the outer surface of the deep cone shaped charge liner, and the inner surface is completely unprocessed, which may significantly improve the material utilization of the cone shaped charge liner.

(4) The product quality is effectively controlled. Through the strict specification control of process parameters such as deformation pass, deformation amount, temperature and time, the required microstructure is obtained, the effectiveness control of the product quality of the components is realized, and the stability and uniformity of the products are improved.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION OF THE EMBODIMENTS

The present invention is further described below with reference to the specific embodiments.

Embodiment 1

(1) Preparation of billet: taking a shaped charge liner having an inner chamber with a shape of a double cone structure and a tapered wall thickness as an example, the shaped charge liner has an aperture of ϕ165 mm, a height of 178 mm, an inner cone depth of 142 mm, a wall thickness of 2.4 mm to 3.2 mm, a top small cone angle of 36°, a large cone angle of 64°, and a transition arc R between the large and small cone angle of 220 mm. According to plastic forming theory and near-uniform plastic deformation principle, a machining allowance of 0.3 mm is left on the outer surface of the shaped charge liner, and a forming process boss of ϕ25 mm is designed on the top of the cone shaped charge liner; the forming process is simulated and optimized by UG and DEFORM software, and the volume of the billet is calculated. The extruded T2 copper rod of ϕ90 mm is selected as the raw material, and the outer surface of the rod was cut to make a billet having a diameter of 88 mm and a height of 55 mm. The content of the impurity element of the T2 red copper rod is as shown in Table 1.

TABLE 1

| Content of impurity element of T2 copper rod | | | | | | | | | | |
|---|---|---|---|---|---|---|---|---|---|---|
| Brand | Bi | Sb | As | Fe | Ni | Sn | S | O | Zn | Total |
| T2 | 0.001 | 0.002 | 0.002 | 0.005 | 0.002 | 0.002 | 0.004 | 0.005 | 0.004 | 0.1 |

Figure 1:
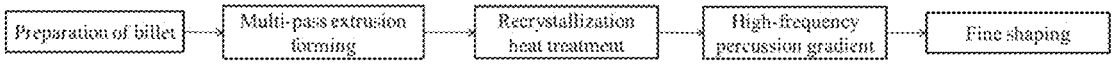
FIG. 1 is a flow chart of a preparation process of a shaped charge liner.
Figure 2:
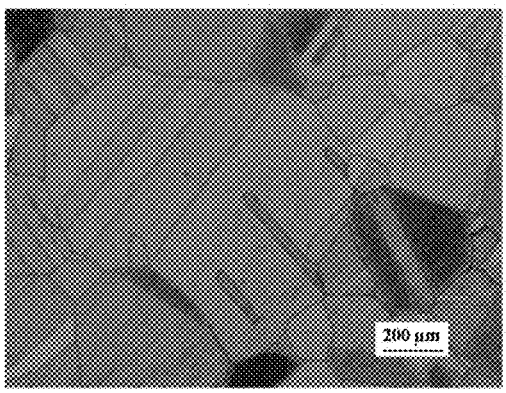
FIG. 2 is a diagram showing a grain structure of a red copper billet (metallographic microscope is magnified 50 times, and average grain size is about 210 μm)

The billet is kept in a VQG-2500 intelligent temperature-controlled vacuum heat treatment furnace at 420±1° C. for 1.5 h, and the degree of vacuum is $1.5\times10^{-3}$ Pa. After the heat preservation treatment, the billet is cooled to 80° C. with the furnace to obtain a billet with uniform composition and structure. The hardness is from HB35 to HB38, and the average grain size is about 210 μm, as shown in FIG. 2.

Figure 3:
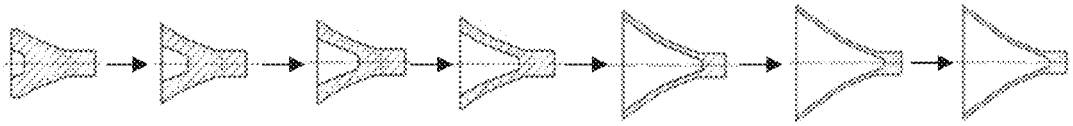
FIG. 3 is a diagram showing a multi-pass extrusion forming process of a double cone shaped charge liner.

(2) Multi-pass extrusion forming: the billet obtained in step (2) is placed in the mould cavity of the extrusion die, under the actions of the three-dimensional compressive stress and a certain deformation rate, 7 passes of the extrusion deformation are performed to obtain the cone shaped charge liner, and its forming process is shown in FIG. 3. The deformation amount arrangement for each pass is shown in Table 2. The multi-pass extrusion die includes die system, punch system, and ejection system. The multi-pass extrusion forming equipment is 1600 t hydraulic press, and deformation rate of the hydraulic machine is 2 mm/s to 5 mm/s. The die system of the extrusion die is installed on the work surface of the hydraulic press. The ejection system is connected with the ejector mechanism of the hydraulic press. The punch system is connected with the working slider of the hydraulic press and the extrusion punch is driven by the working slider of the hydraulic press to perform extrusion. The extrusion punch cooperates with the extrusion concave die to make the billet in a three-dimensional stress state. The first pass is a large deformation cogging process to obtain a cone billet. The subsequent 2 to 6 passes are reaming extrusion (the deformation amount is less than 30%), so that the wall thickness of the shaped charge liner is gradually thinned. As the extrusion pass increases, the work hardening effect is enhanced and the deformation amount gradually decreases. The last pass is the final shaping, which improves the dimensional accuracy and dimensional stability of the formed component, and the deformation amount is generally less than 10%. After the multi-pass extrusion forming, a shaped charge liner having the required shape, size, surface quality, and a certain mechanical property is obtained.

TABLE 2

Process parameters of the extrusion deformation

| Deformation Pass | Deformation Amount Arrangement | Deformation Rate | Deformation Temperature | Lubricant |
|---|---|---|---|---|
| 1 | 28% | 4 mm/s | 25-30° C. | Tea oil |
| 2 | 28% | | | |
| 3 | 25% | | | |
| 4 | 25% | | | |
| 5 | 20% | | | |
| 6 | 16% | | | |
| 7 | 6% | | | |

Figure 4:
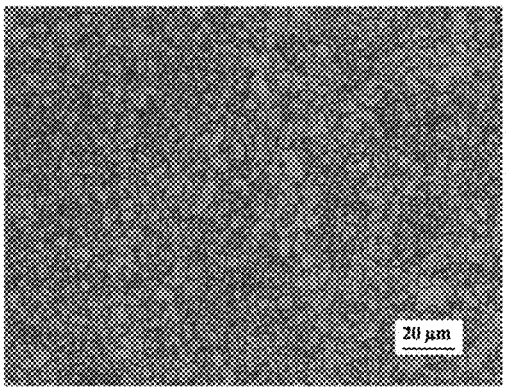
FIG. 4 is a diagram showing a microstructure of a cone shaped charge liner after a recrystallization treatment (metallographic microscope is magnified 500 times, and average grain size is about 6 μm)

(3) Recrystallization heat treatment: the cone shaped charge liner obtained in step (2) is placed in a vacuum heat treatment furnace, and is kept at 210° C. for 60 min, then the grain boundary optimization, and the dislocation slip and dislocation climbing are performed by recrystallization treatment, causing the change of the local lattice and the interface orientation of grain boundary, promoting the formation of dynamic recrystallization and twinning during annealing, and reducing the work hardening effect. The average grain size of the shaped charge liner is about 6 μm, as shown in FIG. 4.

(4) High-frequency percussion gradient: an inner surface grain refining treatment is performed on the cone shaped charge liner obtained in step (3) on a high-frequency vibration percussion device, the percussion speed is 32,000 times/min, the percussion force is 1500 N, and the number of percussion times is 2.

(5) Fine shaping: the component obtained in step (4) is placed in the mould cavity of the extrusion die, under the actions of three-dimensional compressive stress and deformation rate of 1 mm/s, 2 passes of fine shaping are performed, and the deformation amount for each pass is about 1%.

The difference of circumferential wall thickness of the cone shaped charge liner is 0.02 mm to 0.07 mm, and the roughness of inner surface is Ra 0.03 μm to Ra 0.1 μm, and the deviation value of the taper angle is less than or equal to 2'.

Figure 5A:
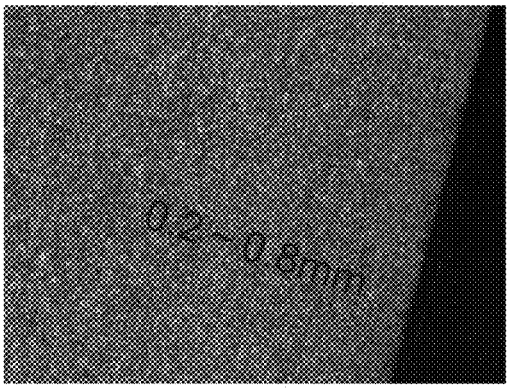
FIG. 5*a* is a diagram showing a gradient structure distribution of a gradient grain structure of a shaped charge liner along a thickness direction.
Figure 5B:
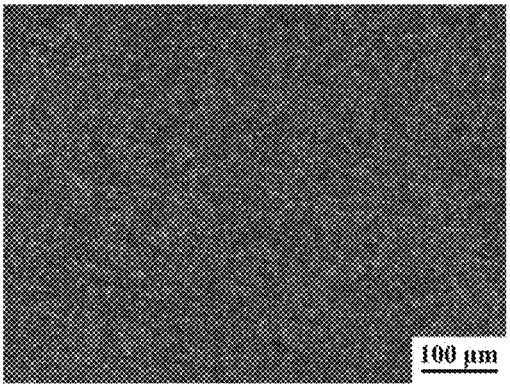
FIG. 5*b* is a diagram showing a size of a grain structure 0.8 mm away from an inner wall in a gradient grain structure of a shaped charge liner along a thickness direction is about 3 μm.
Figure 5C:
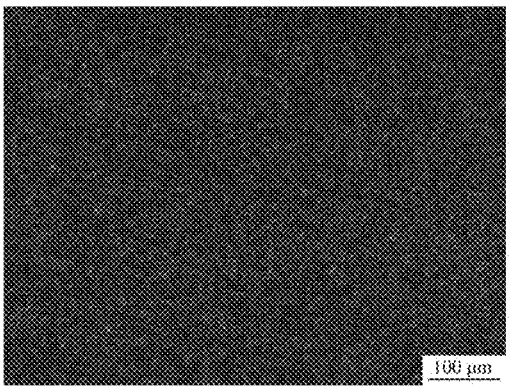
FIG. 5*c* is a diagram showing a size of a grain structure 0.2 mm away from an inner wall in a gradient grain structure of a shaped charge liner along a thickness direction is about 0.6 μm.

The grain size distribution of the above-mentioned shaped charge liner is analyzed by using the metallographic microscopic method (Table 3). The gradient fine grain structure is formed along the wall thickness of the shaped charge liner (FIG. 5*a*). The average grain size of the grain structure 0.8 mm away from the inner wall is about 3 μm (FIG. 5*b*) and the average grain size of the grain structure 0.2 mm away from the inner wall is about 0.6 μm (FIG. 5*c*).

TABLE 3

Grain structure distribution of shaped charge liner along thickness direction and generatrix direction

| | Distance from inner surface | | | | |
|---|---|---|---|---|---|
| | 0.2 mm | 0.4 mm | 0.6 mm | 0.8 mm | 1 mm |
| 1-small cone | 0.61 | 1.0 | 1.9 | 2.7 | 4.5 |
| 2-circular arc | 0.56 | 1.2 | 1.8 | 3.1 | 5.1 |
| 3-big cone | 0.68 | 1.3 | 2.1 | 3.2 | 4.8 |
| 4-opening | 0.75 | 1.1 | 1.9 | 2.8 | 5.2 |
| Average value | 0.65 | 1.15 | 1.93 | 2.95 | 4.9 |

Embodiment 2

(1) Preparation of billet: taking a shaped charge liner having an inner chamber with a shape of single cone structure and an equal wall thickness as an example, the shaped charge liner has an aperture of ϕ156 mm, a height of 162 mm, an inner cone depth of 148 mm, a maximum wall thickness of 3.2 mm, and an inner taper angle of 60°. According to plastic forming theory and near-uniform plastic deformation principle, a machining allowance of 0.4 mm is left on the outer surface of the shaped charge liner formed by multi-pass extrusion forming, and a forming process boss of ϕ20 mm is designed on the top of the shaped charge liner. The forming process is simulated and optimized by UG and DEFORM software and the volume of the billet is calculated. The stretched T2 copper rod of ϕ60 mm is selected as the raw material and the outer surface of the rod was cut to make a billet having a diameter of 58 mm and a height of 80 mm. The billet is kept in a VQG-2500 intelligent temperature-controlled vacuum heat treatment furnace at 400±1° C. for 2 h, and the degree of vacuum is $1.5\times10^{-3}$ Pa. After the heat preservation treatment, the billet is cooled to 80° C. with the furnace to obtain a billet having uniform composition and structure. The hardness is from HB32 to HB35, and the grain size of the copper is about 70 μm.

(2) Multi-pass extrusion forming: the billet obtained in step (1) is placed in the mould cavity of the extrusion die, under the actions of the three-dimensional compressive stress and a certain deformation rate, 6 passes of the extrusion deformation are performed, and the deformation amount arrangement for each pass is shown in Table 4. The multi-pass extrusion die includes a die system, a punch system, and an ejection system. The multi-pass extrusion equipment is 1600 t hydraulic press, and the deformation rate of the hydraulic machine is 2 mm/s to 5 mm/s. The die system of the extrusion die is installed on the work surface of the hydraulic press. The ejection system is connected with the ejector mechanism of the hydraulic press. The punch system is connected with the working slider of the hydraulic press, and the extrusion punch is driven by the working slider of the hydraulic press to perform extrusion. The extrusion punch cooperates with the extrusion concave die to make the billet in a three-dimensional stress state. The first pass is a large deformation cogging to obtain a cone billet. The subsequent 2 to 5 passes are reaming extrusion (the deformation amount is less than 30%), so that the wall thickness of the shaped charge liner is gradually thinned. As the extrusion pass increases, the work hardening effect is enhanced, and the deformation amount gradually decreases. The last pass is the final shaping, which improves the dimensional accuracy and dimensional stability of the formed component, and the deformation amount is generally less than 10%. After the multi-pass extrusion forming, a shaped charge liner having the required shape, size, surface quality, and a certain mechanical property is obtained.

TABLE 4

Parameters of deformation pass

| Deformation Pass | Deformation Amount Arrangement | Deformation Rate | Deformation Temperature | Lubricant |
|---|---|---|---|---|
| 1 | 28% | 3 mm/s | 25-30° C. | Rapeseed oil |
| 2 | 25% | | | |
| 3 | 23% | | | |
| 4 | 22% | | | |

TABLE 4-continued

| Parameters of deformation pass | | | | |
|---|---|---|---|---|
| Deformation Pass | Deformation Amount Arrangement | Deformation Rate | Deformation Temperature | Lubricant |
| 5 | 16% | | | |
| 6 | 8% | | | |

(3) Recrystallization heat treatment: the cone shaped charge liner obtained in step (2) is placed in a vacuum heat treatment furnace, and kept at 200° C. for 60 min, then the grain boundary optimization, the dislocation slip and dislocation climbing are performed by recrystallization treatment, causing the change of local lattice and the interface orientation of grain boundary, promoting the formation of dynamic recrystallization and twinning during annealing, and reducing the work hardening effect. The average grain size of the shaped charge liner is 4 μm.

(4) High-frequency percussion gradient: an inner surface grain refining treatment is performed on the cone shaped charge liner obtained in step (3) on a high-frequency vibration percussion device, the percussion speed is 35,000 times/min, the percussion force is 2000 N, and the number of percussion times is 3.

(5) Fine shaping: the component obtained in step (4) is placed in the mould cavity of the extrusion die, under the actions of three-dimensional compressive stress and deformation rate of 2 mm/s, 1 pass of fine shaping is performed, and the deformation amount for the pass is about 1%.

The difference of circumferential wall thickness of the cone shaped charge liner is 0.02 mm to 0.05 mm, and the roughness of inner surface is Ra 0.01 μm to Ra 0.08 μm, and the deviation value of the taper angle is less than or equal to 1'.

The grain size distribution of the above-mentioned shaped charge liner is analyzed by using the metallographic microscopic method (Table 5). The gradient fine grain structure is formed along the wall thickness of the shaped charge liner. The average grain size of the grain structure 0.8 mm away from the inner wall is about 2 μm, and the average grain size of the grain structure 0.2 mm away from the inner wall is about 0.2 μm.

TABLE 5

| Grain structure distribution of shaped charge liner along thickness direction and generatrix direction | | | | | |
|---|---|---|---|---|---|
| | Distance from inner surface | | | | |
| | 0.2 mm | 0.4 mm | 0.6 mm | 0.8 mm | 1 mm |
| 1-small cone | 0.15 | 0.47 | 1.1 | 1.7 | 2.4 |
| 2-circular arc | 0.20 | 0.54 | 1.4 | 1.8 | 2.8 |
| 3-big cone | 0.18 | 0.72 | 1.2 | 2.1 | 2.7 |
| 4-opening | 0.24 | 0.58 | 1.5 | 1.9 | 2.9 |
| Average value | 0.19 | 0.58 | 1.30 | 1.88 | 2.7 |

The results show that the forming and the surface quality control of the deep cone shaped charge liner are achieved by using a control technology of a severe deformation accumulated by multi-pass extrusion forming; the plasticity of the material is improved by static recrystallization treatment, and fine grain structure is obtained. The high-frequency percussion grain refining technology is used to form an ultrafine grain gradient structure distributed along thickness direction on the inner surface of the shaped charge liner. By this method, the difference of circumferential wall thickness of the shaped charge liner is 0.02 mm to 0.07 mm, the roughness of inner surface is Ra 0.01 μm to Ra 0.1 μm, the deviation value of the taper angle is less than or equal to 2', and the internal structure has ultrafine grain gradient, effectively and fully utilizing the physical properties of the fine crystalline material. X-ray photography shows that rupture time of the jet of the shaped charge liner prepared by the method of the present invention is extended by about 6% compared to that prepared by the conventional process. The effective length of the jet is increased by about 10%, and the collimation is better. The static high-explosive anti-tank test is performed on the shaped charge liner prepared by Embodiment 1, uniform steel target having a thickness of 1450 mm can be effectively penetrated, and the penetration depth thereof is increased by more than 200 mm compared to the shaped charge liner formed by conventional forming process.

What is claimed is:

1. A method for forming a grain size gradient of an ultrafine crystallization microstructure of a copper cone shaped charge liner, comprising steps of an extrusion forming, a recrystallization heat treatment, and a high-frequency percussion;

wherein a multi-pass extrusion forming is used in the step of the extrusion forming, and in the step of the high-frequency percussion, a percussion speed is 30,000 times/min to 40,000 times/min, a percussion force is 1600 N to 2000, wherein the gradient control method comprises the following steps:

(1) preparation of a billet: a copper rod is selected to prepare a first billet, and a diameter of the copper rod is ϕ 60 mm to 90 mm; the first billet is put into a vacuum heat treatment furnace to perform an annealing treatment;

(2) the multi-pass extrusion forming: the billet obtained in the step (1) is placed in a mould cavity of an extrusion die, under action of a three-dimensional compressive stress to obtain a first copper cone shaped charge liner;

(3) the recrystallization heat treatment: the first copper cone shaped charge liner obtained in the step (2) is placed in the vacuum heat treatment furnace to obtain a second copper cone shaped charge liner;

(4) fine shaping: the second copper cone shaped charge liner obtained in the step 3 is placed in the mould cavity of the extrusion die, under actions of a three-dimensional compressive stress to obtain a third copper cone shaped charge liner.

2. The method for forming the grain size gradient of an ultrafine crystallization microstructure of the copper cone shaped charge liner of claim 1, wherein the multi-pass extrusion forming is 4 to 8 passes of extrusion deformation under actions of the three-dimensional compressive stress and a deformation rate of 2 mm/s to 5 mm/s, a deformation amount of each pass of the 4 to 8 passes of extrusion deformation is 5% to 30%.

3. The method for forming the grain size gradient of an ultrafine crystallization microstructure of the copper cone shaped charge liner of claim 1, wherein a temperature of the recrystallization heat treatment is kept at 180° C. to 220° C., a holding time of the recrystallization heat treatment is 45 min to 75 min.

4. The method for forming the grain size gradient of an ultrafine crystallization microstructure of the copper cone shaped charge liner of claim 1, wherein an annealing temperature is 400° C. to 450° C., an annealing time is 1.5 h to 2 h, and then cooling to below 100° C. with a vacuum heat treatment furnace is performed, a pressure of the vacuum heat treatment furnace is less than or equal to $2\times10^{-3}$ Pa.

5. The method for forming the grain size gradient of an ultrafine crystallization microstructure of the copper cone shaped charge liner of claim 1, wherein:

an annealing temperature is 400° C. to 450° C., annealing time is 1.5 h to 2 h, and the first billet is cooled to below 100° C. with the vacuum heat treatment furnace to obtain the billet, a pressure of the vacuum heat treatment is less than or equal to $2\times10^{-3}$ Pa;

a deformation rate of the extrusion forming is 2 mm/s to 5 mm/s, 4 to 8 passes of extrusion deformation are performed to obtain a first deep cone copper shaped charge liner, and a deformation amount for each pass of the 4 to 8 passes of extrusion deformation is between 5% and 30%;

a temperature of the recrystallization heat treatment is kept at 180° C. to 220° C., and holding time of the recrystallization heat treatment is 45 min to 75 min;

a deformation rate of the fine shaping is 1 mm/s to 3 mm/s, 1 to 4 passes of the fine shaping are performed, and a deformation amount for each pass of the fine shaping is less than or equal to 2%.

6. The method for forming the grain size gradient of an ultrafine crystallization microstructure of the copper cone shaped charge liner of claim 2, wherein the recrystallization heat treatment is carried out in the vacuum heat treatment furnace, a temperature of the recrystallization heat treatment is kept at 180° C. to 220° C., a holding time of the recrystallization heat treatment is 45 min to 75 min.

7. The method for forming the grain size gradient of an ultrafine crystallization microstructure of the copper cone shaped charge liner of claim 2, wherein an annealing temperature is 400° C. to 450° C., an annealing time is 1.5 h to 2 h, and then cooling to below 100° C. with a vacuum heat treatment furnace is performed, a pressure of the vacuum heat treatment is less than or equal to $2\times10^{-3}$ Pa.

8. The method for forming the grain size gradient of an ultrafine crystallization microstructure of the copper cone shaped charge liner of claim 2, wherein a material designation of the copper rod is chosen from a group of TU1, TU2, T2, T3; the first billet is put into the vacuum heat treatment furnace to perform the annealing treatment, an annealing temperature is 400° C. to 450° C., annealing time is 1.5 h to 2 h, and then the first billet is cooled to below 100° C. with the vacuum heat treatment furnace to obtain the billet, a pressure of the vacuum heat treatment is less than or equal to $2\times10^{-3}$ Pa;

a deformation rate of the extrusion forming is 2 mm/s to 5 mm/s, the 4 to 8 passes of extrusion deformation are performed to obtain a first copper cone shaped charge liner, and the deformation amount for each pass of the 4 to 8 passes of extrusion deformation is between 5% and 30%;

a temperature of the recrystallization heat treatment is kept at 180° C. to 220° C., and holding time of the recrystallization heat treatment is 45 min to 75 min;

a deformation rate of the fine shaping is 1 mm/s to 3 mm/s, 1 to 4 passes of the fine shaping are performed, and a deformation amount for each pass of the fine shaping is less than or equal to 2%.

9. The method for forming the grain size gradient of an ultrafine crystallization microstructure of the copper cone shaped charge liner of claim 3, wherein an annealing temperature is 400° C. to 450° C., an annealing time is 1.5 h to 2 h, and then cooling to below 100° C. with the vacuum heat treatment furnace is performed, a pressure of the vacuum heat treatment is less than or equal to $2\times10^{-3}$ Pa.

10. The method for forming the grain size gradient of an ultrafine crystallization microstructure of the copper cone shaped charge liner of claim 3, wherein a material designation of the copper rod is chosen from a group of TU1, TU2, T2, T3; the first billet is put into the vacuum heat treatment furnace to perform the annealing treatment, an annealing temperature is 400° C. to 450° C., annealing time is 1.5 h to 2 h, and then the first billet is cooled to below 100° C. with the vacuum heat treatment furnace to obtain the billet, a pressure of the vacuum heat treatment is less than or equal to $2\times10^{-3}$ Pa;

a deformation rate of the extrusion forming is 2 mm/s to 5 mm/s, the 4 to 8 passes of extrusion deformation are performed to obtain a first copper cone shaped charge liner, and the deformation amount for each pass of the 4 to 8 passes of extrusion deformation is between 5% and 30%;

a temperature of the recrystallization heat treatment is kept at 180° C. to 220° C., and holding time of the recrystallization heat treatment is 45 min to 75 min;

a deformation rate of the fine shaping is 1 mm/s to 3 mm/s, 1 to 4 passes of the fine shaping are performed, and a deformation amount for each pass of the fine shaping is less than or equal to 2%.

11. The method for forming the grain size gradient of an ultrafine crystallization microstructure of the copper cone shaped charge liner of claim 4, wherein a material designation of the copper rod is chosen from a group of TU1, TU2, T2, T3; the first billet is put into the vacuum heat treatment furnace to perform the annealing treatment, an annealing temperature is 400° C. to 450° C., annealing time is 1.5 h to 2 h, and then the first billet is cooled to below 100° C. with the vacuum heat treatment furnace to obtain the billet, a pressure of the vacuum heat treatment is less than or equal to $2\times10^{-3}$ Pa;

a deformation rate of the extrusion forming is 2 mm/s to 5 mm/s, the 4 to 8 passes of extrusion deformation are performed to obtain a first copper cone shaped charge liner, and the deformation amount for each pass of the 4 to 8 passes of extrusion deformation is between 5% and 30%;

a temperature of the recrystallization heat treatment is kept at 180° C. to 220° C., and holding time of the recrystallization heat treatment is 45 min to 75 min;

a deformation rate of the fine shaping is 1 mm/s to 3 mm/s, 1 to 4 passes of the fine shaping are performed, and a deformation amount for each pass of the fine shaping is less than or equal to 2%.

12. The method for forming the grain size gradient of an ultrafine crystallization microstructure of the copper cone shaped charge liner of claim 6, wherein a material designation of the copper rod is chosen from a group of TU1, TU2, T2, T3; the first billet is put into the vacuum heat treatment furnace to perform the annealing treatment, an annealing temperature is 400° C. to 450° C., annealing time is 1.5 h to 2 h, and then the first billet is cooled to below 100° C. with the vacuum heat treatment furnace to obtain the billet, a pressure of the vacuum heat treatment is less than or equal to $2\times10^{-3}$ Pa;

a deformation rate of the extrusion forming is 2 mm/s to 5 mm/s, the 4 to 8 passes of extrusion deformation are performed to obtain a first copper cone shaped charge liner, and the deformation amount for each pass of the 4 to 8 passes of extrusion deformation is between 5% and 30%;

a temperature of the recrystallization heat treatment is kept at 180° C. to 220° C., and holding time of the recrystallization heat treatment is 45 min to 75 min;

a deformation rate of the fine shaping is 1 mm/s to 3 mm/s, 1 to 4 passes of the fine shaping are performed, and a deformation amount for each pass of the fine shaping is less than or equal to 2%.

13. The method for forming the grain size gradient of an ultrafine crystallization microstructure of the copper cone shaped charge liner of claim 7, wherein a material designation of the copper rod is chosen from a group of TU1, TU2, T2, T3; the first billet is put into the vacuum heat treatment furnace to perform the annealing treatment, an annealing temperature is 400° C. to 450° C., annealing time is 1.5 h to 2 h, and then the first billet is cooled to below 100° C. with the vacuum heat treatment furnace to obtain the billet, a pressure of the vacuum heat treatment is less than or equal to $2\times10^{-3}$ Pa;

a deformation rate of the extrusion forming is 2 mm/s to 5 mm/s, the 4 to 8 passes of extrusion deformation are performed to obtain a first copper cone shaped charge liner, and the deformation amount for each pass of the 4 to 8 passes of extrusion deformation is between 5% and 30%;

a temperature of the recrystallization heat treatment is kept at 180° C. to 220° C., and holding time of the recrystallization heat treatment is 45 min to 75 min;

a deformation rate of the fine shaping is 1 mm/s to 3 mm/s, 1 to 4 passes of the fine shaping are performed, and a deformation amount for each pass of the fine shaping is less than or equal to 2%.

14. The method for forming the grain size gradient of an ultrafine crystallization microstructure of the copper cone shaped charge liner of claim 9, wherein a material designation of the copper rod is chosen from a group of TU1, TU2, T2, T3; the first billet is put into the vacuum heat treatment furnace to perform the annealing treatment, an annealing temperature is 400° C. to 450° C., annealing time is 1.5 h to 2 h, and then the first billet is cooled to below 100° C. with the vacuum heat treatment furnace to obtain the billet, a pressure of the vacuum heat treatment is less than or equal to $2\times10^{-3}$ Pa;

a deformation rate of the extrusion forming is 2 mm/s to 5 mm/s, the 4 to 8 passes of extrusion deformation are performed to obtain a first copper cone shaped charge liner, and the deformation amount for each pass of the 4 to 8 passes of extrusion deformation is between 5% and 30%;

a temperature of the recrystallization heat treatment is kept at 180° C. to 220° C., and holding time of the recrystallization heat treatment is 45 min to 75 min;

a deformation rate of the fine shaping is 1 mm/s to 3 mm/s, 1 to 4 passes of the fine shaping are performed, and a deformation amount for each pass of the fine shaping is less than or equal to 2%.

* * * * *